United States Patent [19]

Shimoyama et al.

[11] 3,935,038

[45] Jan. 27, 1976

[54] METHOD FOR MANUFACTURING NON-ORIENTED ELECTRICAL STEEL SHEET AND STRIP HAVING NO RIDGING

[75] Inventors: Yoshiaki Shimoyama; Kunisuke Miyoshi; Hiroyuki Kimura, all of Kitakyushu, Japan

[73] Assignee: Nippon Steel Corporation, Japan

[22] Filed: Dec. 3, 1974

[21] Appl. No.: 529,099

Related U.S. Application Data

[63] Continuation-in-part of Ser. No. 503,868, Sept. 6, 1974, abandoned, which is a continuation of Ser. No. 301,221, Oct. 26, 1972, abandoned.

[30] Foreign Application Priority Data

Oct. 28, 1971 Japan ..... 46-85752

[52] U.S. Cl. ..... 148/110; 75/123 L; 148/31.55; 148/111; 148/112

[51] Int. Cl.[2] ..... H01F 1/04

[58] Field of Search ..... 148/110, 111, 112, 31.55, 148/113, 120, 121, 12; 75/123 L

[56] References Cited

UNITED STATES PATENTS

| | | | |
|---|---|---|---|
| 2,980,561 | 4/1961 | Ford et al. | 148/112 |
| 3,061,486 | 10/1962 | Jackson | 148/31.55 |
| 3,090,711 | 5/1963 | Kohler | 148/111 |
| 3,128,211 | 4/1964 | Waxweiler | 148/112 |
| 3,139,358 | 6/1964 | Graziano | 148/12 |
| 3,178,318 | 4/1965 | Shimzu et al. | 148/12 |
| 3,203,839 | 8/1965 | Takahashi | 148/111 |
| 3,347,718 | 10/1967 | Carpenter et al. | 148/111 |
| 3,522,114 | 7/1970 | Knuppel et al. | 148/112 |
| 3,671,337 | 6/1972 | Kumai et al. | 148/111 |
| 3,713,812 | 1/1973 | Brickner | 148/12 |

OTHER PUBLICATIONS

McGannon (Ed.); Making Shaping and Treating Steel, U.S. Steel Corp., 1964 p. 1150.

Sachs, G. et al.; Practical Metallurgy; Cleveland (Asm), 1940 pp. 119–121 & 320–321.

*Primary Examiner*—Walter R. Satterfield
*Attorney, Agent, or Firm*—Toren, McGeady and Stanger

[57] ABSTRACT

A method for manufacturing non-oriented electrical steel sheet and strip having no ridging characterized in that, non-oriented electrical steel sheet and strip is manufactured by casting molten silicon steel into a slab, hot-rolling, cold-rolling and annealing, said molten silicon steel, being controlled so as to give a composition, at the time of hot-rolling, comprising C <0.06%, Si 1.5 – 4.0% and Al < 1.0%, with the relation Si + Al > 2.0% and also C ≥ 1/100 [(Si + Al) - 0.75]% with the remainder being iron and unavoidable impurities.

2 Claims, 4 Drawing Figures

State of Laminated Steel Sheets Each Having Ridging on the Interfacial Surface

METHOD FOR MANUFACTURING NON-ORIENTED ELECTRICAL STEEL SHEET AND STRIP HAVING NO RIDGING

CROSS REFERENCE TO PRIOR APPLICATIONS

This application is a continuation-in-part application of a pending prior application Ser. No. 503,868 filed Sept. 6, 1974, and now abandoned, which is a continuation application of a prior application Ser. No. 301,221 filed Oct. 26, 1972 now abandoned.

BACKGROUND OF THE INVENTION

The present invention relates to a method for manufacturing non-oriented silicon steel sheet and strip having a smooth surface condition without the defect of ridging. Particularly, it relates to a method for manufacturing non-oriented silicon steel sheet and strip having no ridging, in which molten silicon steel, whose composition is controlled properly, is made into a slab by casting, and said slab is dealt with by a combination treatment comprising hot-rolling, cold-rolling and annealing.

In recent years, the technical development in the manufacture of non-oriented electrical steel sheet and strip has been very remarkable.

Particularly, various newly developed technics such as, controlling the composition of the molten steel, for instance, by vacuum degas treatment, and ingot making of molten steel have been introduced in the manufacture of electrical steel sheet and strip, and consequently excellent electrical steel sheet and strip can be manufactured.

However, as a result of introducing such new techniques, while a remarkable effect can be obtained on one hand, new defects are occuring on the other hand.

As an example, particularly, in manufacturing high quality non-oriented electrical steel sheet and strip, when a cold-rolled non-oriented steel strip is manufactured by a combination treatment, comprising a degassing treatment under reduced pressure, continuous casting and cold-rolling, lengthwise strips called ridging appear continuously in parallel with the rolling direction on the surface thereof.

The above-mentioned lengthwise stripes, namely, ridging or ribbing or roping, demonstrate continuous undulation in the form of so-called lengthwise stripes along the rolling direction on the surface of the cold-rolled steel sheet, wherein the crest and the trough of the foregoing undulation are extended to run nearly in parallel with the rolling direction. As one surface of the produced steel sheet is being formed, for instance, in a concave shape, the other surface thereof which corresponds to said one surface would be formed naturally in a convex shape, the configuration of the upper surface and the lower surface of the steel sheet should be closely matched with each other. Further, the undulation on the surface of the steel sheet is adapted to be increased as the increase of the frequency of the working processes for the steel sheet.

The present invention will be explained referring to the attached drawings.

BRIEF DESCRIPTION OF THE DRAWINGS

FIG. 4 is a view similar to that of FIG. 3, wherein the sheets have a configuration relative to one another.

DESCRIPTION OF THE PREFERRED EMBODIMENT

Figure 1:
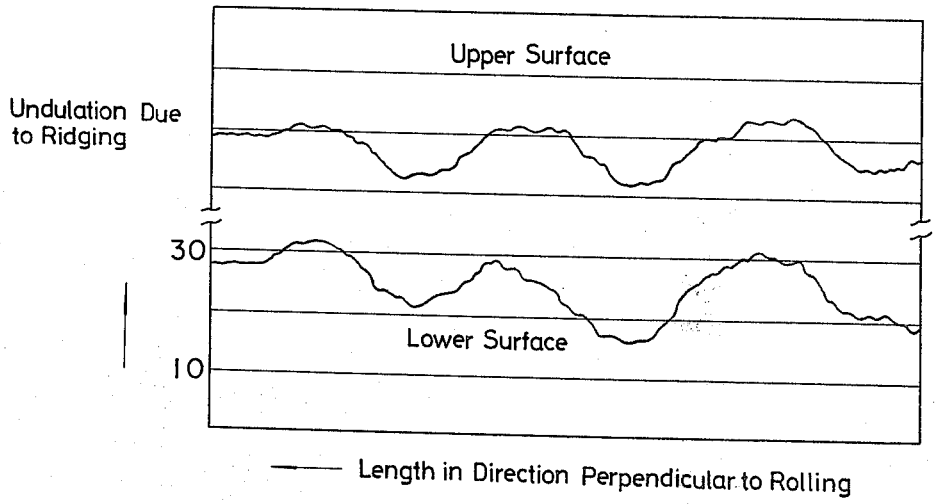
FIG. 1 is a graphical representation of ridging undulation in a steel sheet.

FIG. 1 shows an example of ridging in which the profile thereof clearly demonstrates close matching of the surfaces of steel sheet as described hereinbefore, and the extent of the undulated concave and convex, that is, the difference between the crest and the trough of the undulation is normally comes to the range of several microns to less than scores of microns. According to the experiences of the present inventors, it has come to $30\mu$ at the maximum in case when the steel sheet has 0.35mm plate thickness thereof.

Electrical steel sheet and strip having such ridging inevitably has not only a low commodity value from the standpoint of appearance, but also, a defect in that the lamination factor is low, for instance, in forming a laminated iron core.

The object of the present invention is to offer high quality non-oriented electrical steel sheet and strip having no ridging and thus having no hindrance in its application. The invention will be set forth in the following.

The present invention is a method for manufacturing excellent non-oriented electrical steel sheet and strip in which the composition of molten silicon steel is controlled by a suitable treatment. It is made into a slab having a suitable size by casting, and said slab is subjected to a suitable combination treatment comprising hot-rolling, cold-rolling and annealing. Its main characteristic lies in the composition of a directly cast slab as a base material for hot-rolling.

The steel used in this invention is smelted in a suitable known steel making means, such as, a converter, an arc furnace or an open hearth.

The composition of molten steel need not be controlled in the stage of smelting if it is controlled in the next stage of degassing under reduced pressure. On the other hand, when the contents of C and $O_2$ are controlled in the steel making process, no degassing under reduced pressure is necessary. The degassing may also be carried out at the time of casting. The composition of steel as a base material for hot-rolling is controlled as $C < 0.06\%$ (in weight, hereinafter the amount of constituent will always be expressed by weight %), Si 1.5 – 4.0% and $Al < 1.0$, with the relation $Si + Al > 2.0\%$ and also $C \geq 1/100[(Si+Al) - 0.75]$ %.

In the present invention, the composition of the base material for hot-rolling, i.e., steel slab, is specified in said range.

It is necessary, in the stage of hot-rolling, that the amount of C in the steel have a definite relationship with the amount of Si, or with the total amount of Si and Al if Al is contained therein. The object of preventing the occurrence of ridging in this invention can not be achieved if said relationship in the steel composition is not retained.

Figure 2:
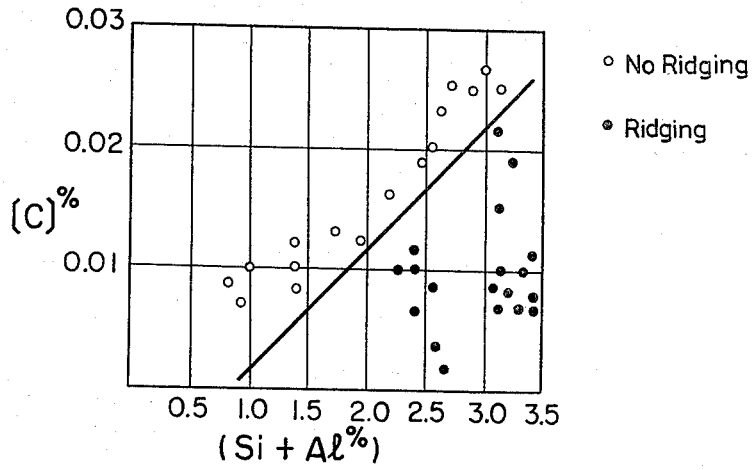
FIG. 2 is a graph of the relationship of the carbon, silicon, and aluminum contents to ridging.

After a result of various investigations on the relationship in the amounts between C and Si + Al, the present inventors found the relation as shown in FIG. 2.

FIG. 2 shows the region of the appearance and non-appearance of ridging in the diagram between the amount of C and the amount of Si + Al in the base material for hotrolling. As obvious from the figure, there is a distinct boundary, straight line (1) in the figure, between the regions of the appearance and non-appearance of ridging. This line can be expressed as a formula, $$C = \frac{1}{100}[(Si + Al) - 0.75]\ \%$$

Thus, it is proved that, in order to obtain a final product having no occurrence of ridging, the relation between the C content and the total amount of Si and Al (when Al is contained) should be, $$C \geq \frac{1}{100}[(Si + Al) - 0.75]\ \%$$

where Si + Al > 2.0%.

In the case of a product being manufactured by means of cold-rolling and other processes subsequent to the hotrolling process from said hot-rolled silicon steel which has properly been controlled its composition as mentioned hereinbefore, the undulation of the plate surface would never be increased to the extent more than 7$\mu$, so that a steel sheet having a flat and smooth surface without ridging can be produced. The steel sheet having the undulated surface of not more than 7$\mu$ produced according to the present invention demonstrates the ratio of space occupancy (the lamination factor) to the extent of more than 98.5% which may cause a problem when the present inventive steel sheet is employed, for instance, as a motor core which is perforated into a specific shape and laminated. Thus the present inventive steel sheet is advantageous since it is capable of preventing deterioration in the magnetic property as well as of enhancing its commercial merit together with exhibiting a desirable appearance.

In the non-oriented electrical steel sheet and strip in this invention, the amount of Si should at least be more than 1.5% in order to exhibit the necessary magnetic characteristics. On the other hand, the amount should at most be less than 4.0%. More than 4.0% of Si makes the cold-rolling difficult, and is not beneficial to the productivity.

The smaller the amount of C is, the better the improvement in magnetic characteristics. In the case when the C content can readily be reduced to a definite value in the decarburizing treatment in the later stage, the base material for hot-rolling may contain some amount of C. However, it seems that 0.06% is generally the upper limit from the standpoint of this treatment. When the C content is more than 0.06% it can hardly be reduced to a definite value in the decarburizing annealing.

While Al is not a necessary component in the steel composition of this invention, it may be added in some instances for improving the magnetic characteristics and controlling the crystal grain size in the final product. The amount should be less than 1.0%. More than 1.0% of Al injures the hot-rolling characteristic and makes the treatment, such as, decarburizing annealing difficult. In adding Al for this object, the addition of at least more than 0.2% is recommended. However, Al may not necessarily be added in this invention.

In this invention, Mn may be added in the range less than 1% for the purpose of improving the rolling characteristics. Less than 0.2% of P may also be added for controlling the hardness of the final product in order to improve the punchability and cutting property.

Molten steel having said composition is made directly into a slab with a definite size by casting. The slab thus cast is hot-rolled by a conventional method to obtain a hot-rolled steel sheet or strip with a medium guage. This hot-rolled steel sheet or strip is acid pickled and coldrolled to a final guage.

The combination treatment, in which the hot-rolled steel sheet is annealed preliminarily, acid pickled and coldrolled, belongs naturally to the scope of this invention. The cold-rolling may be done in one stage, or in two or more stages inserting an intermediate annealing.

Steel sheet and strip, cold-rolled to a final guage in this way, is subjected to a final annealing to obtain the desired magnetic characteristics. If necessary, decarburization annealing is used in order to reduce the carbon content after the hot or cold rolling.

As above explained, the main characteristic of this invention lies in the composition of the base material for hot-rolling obtained by the direct casting of the molten steel. Examples of the invention follow.

EXAMPLE

Molten steel smelted in a converter was treated by vacuum degassing and cast directly into a slab.

The analyses of the slab were as in Table 1.

Table 1

| Example | Mark | Analyses % C | Si | Al | Mn | P | Si+Al % |
|---|---|---|---|---|---|---|---|
| Comparison | A-1 | 0.015 | 2.86 | 0.301 | 0.22 | 0.015 | 3.161 |
| Inventive | A-2 | 0.025 | 2.71 | 0.212 | 0.20 | 0.013 | 2.922 |
| Comparison | B-1 | 0.011 | 2.20 | 0.178 | 0.22 | 0.150 | 2.378 |
| Inventive | B-2 | 0.019 | 2.08 | 0.368 | 0.24 | 0.014 | 2.448 |
| Inventive | C-1 | 0.012 | 1.71 | 0.166 | 0.65 | 0.20 | 1.876 |
| Inventive | C-2 | 0.007 | 0.85 | tr | 0.20 | 0.013 | 0.85 |
| Comparison | D-1 | 0.007 | 3.45 | tr | 0.08 | 0.022 | 3.450 |
| Inventive | D-2 | 0.025 | 3.15 | tr | 0.10 | 0.006 | 3.150 |

Table 2

| Mark | Thickness | Magnetic characteristics $W_{10/50}$ | $W_{15/50}$ | $B_{20}$ | $B_{40}$ | State of ridging occurrence yes or no | Degree of undulation | Lamination factor |
|---|---|---|---|---|---|---|---|---|
| | mm | Watt/kg | Watt/kg | wb/m² | wb/m² | | $\mu$ | % |
| A-1 | 0.35 | 1.24 | 3.05 | 1.55 | 1.63 | yes | 18 | 96.7 |
| | 0.50 | 1.41 | 3.23 | 1.56 | 1.65 | yes | 13 | 97.4 |
| A-2 | 0.35 | 1.19 | 2.84 | 1.54 | 1.63 | no | 3 | 99.1 |
| | 0.50 | 1.40 | 3.25 | 1.56 | 1.64 | no | 2 | 99.3 |
| B-1 | 0.35 | 1.39 | 3.08 | 1.55 | 1.64 | yes | 22 | 98.7 |
| | 0.50 | 1.59 | 3.56 | 1.57 | 1.65 | yes | 15 | 99.0 |
| B-2 | 0.35 | 1.42 | 3.30 | 1.57 | 1.65 | no | 3 | 99.1 |
| | 0.50 | 1.69 | 3.83 | 1.59 | 1.68 | no | 2 | 99.3 |

Table 2-continued

| Mark | Thickness | $W_{10/50}$ | $W_{15/50}$ | $B_{20}$ | $B_{40}$ | Magnetic characteristics State of ridging occurrence yes or no | Degree of undulation | Lamination factor |
|---|---|---|---|---|---|---|---|---|
| C-1 | 0.50 | 1.84 | 4.03 | 1.60 | 1.69 | no | 4 | 99.0 |
| C-2 | 0.50 | 2.93 | 5.84 | 1.65 | 1.73 | no | 5 | 99.0 |
| D-1 | 0.35 | 1.27 | 2.89 | 1.51 | 1.60 | yes | 25 | 96.5 |
| | 0.50 | 1.48 | 3.36 | 1.54 | 1.61 | yes | 25 | 97.0 |
| D-2 | 0.35 | 1.25 | 2.91 | 1.49 | 1.59 | no | 4 | 99.1 |
| | 0.50 | 1.43 | 3.22 | 1.52 | 1.63 | no | 2 | 99.4 |

A slab having said composition as shown in Table 1 was hot-rolled and wound up as a hot-coil with a thickness of 2.3mm, subjected to a preliminary annealing for 15 hours at 730°C, acid pickled to remove the scale on the surface, cold-rolled to obtain cold-rolled strips with a thickness of, respectively, 0.35mm, and 0.50mm, subjected to the final annealing for 30 seconds at 1000°C.

The magnetic characteristics and the state of ridging occurrence of the products obtained are shown in Table 2.

As is obvious from Table 2, all of the silicon steel strips manufactured according to the present invention shown a smooth surface having no ridging, whereas those manufactured according to any method other than the present invention show an undulate surface having ridging.

Figure 3A:
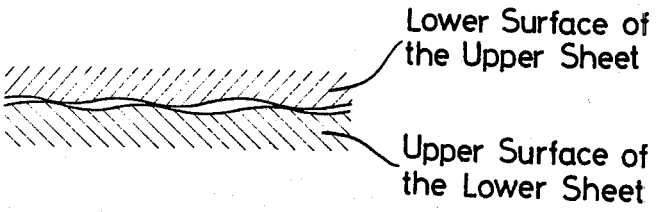
FIG. 3 is a cross sectional view, in detail, of laminated steel sheets having ridging.

In the above mentioned Table 2, the basis of the excellent lamination factors in the lines of specimens of B-1, respectively, irrespective of the relatively large numerical values of ridging, lies in that the steel sheets of B-1 specimens happened to be laminated closely one upon the other as shown in FIG. 3*a* in such a manner that each of the crests of the upper sheet is adapted to engage within a corresponding trough of the lower sheet and each of the troughs of the upper sheet is meshed with corresponding crest of the lower sheet. Thus the laminated steel sheets are formed in a state of close mutual contacting on their entire interfacial plane.

Figure 3B:
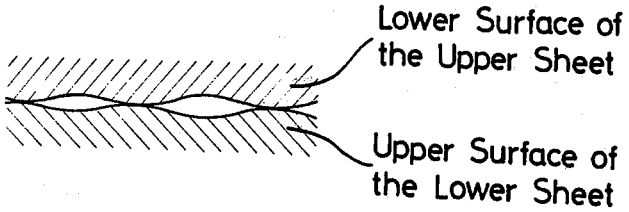

On the other hand, although steel sheets having ridging respectively similar to those as mentioned hereinbefore are laminated one upon the other as shown in FIG. 3*b* in such a manner that each of the crests of the upper sheet is adapted to butt against the corresponding crest of the lower sheet while each of the troughs of the upper sheet and the corresponding trough of the lower sheet are adapted to face to each other produce a space between the upper and the lower troughs, the lamination factor will be lowered. Accordingly, the lamination factor of steel sheets may be small even though they have ridgings with large undulations.

What is claimed is:

1. In a method for manufacturing non-oriented electrical steel sheet and strip wherein molten silicon steel is cast into a slab which is hot rolled, cold rolled, and annealed, the improvement which comprises controlling the composition of the steel so that the composition at the time of hot rolling comprises $C \leq 0.06\%$
$Si = 1.5$ to $4.0\%$
$Al < 1.0\%$,
$Si + Al \geq 2.0\%$, and
$C > 1/100\ (Si + Al) - 0.75\%$, with the remainder being iron and unavoidable impurities, such that the sheet possesses ridging having undulations of not more than about 7 microns.

2. In a method for manufacturing non-oriented electrical steel sheet and strip wherein molten silicon steel is cast into a slab which is hot rolled, cold rolled, and annealed, the improvement which comprises controlling the composition of the steel such that the composition of the steel at the time of hot rolling comprises $C \leq 0.06\%$
$Si = 1.5$ to $4.0\%$,
$Al < 1.0\%$,
$Si + Al \geq 2.0\%$, and
$C > 1/100\ (Si + Al) - 0.75\%$, and wherein the steel further comprises a member selected from the group consisting of Mn - 1.0%, P - 0.20%, and combinations thereof, with the remainder being iron and unavoidable impurities, such that the steel possesses ridging having undulations of not more than about 7 microns.

* * * * *